US008197043B2

(12) United States Patent
Watanabe et al.

(10) Patent No.: US 8,197,043 B2
(45) Date of Patent: Jun. 12, 2012

(54) INK JET PRINTING APPARATUS AND METHOD FOR FILLING INK INTO INK TANK IN INK JET PRINTING APPARATUS

(75) Inventors: Shigeru Watanabe, Yokohama (JP); Naoaki Wada, Yokohama (JP); Yohji Ara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 12/717,341

(22) Filed: Mar. 4, 2010

(65) Prior Publication Data

US 2010/0231621 A1 Sep. 16, 2010

(30) Foreign Application Priority Data

Mar. 10, 2009 (JP) ..... 2009-056899

(51) Int. Cl.
*B41J 2/195* (2006.01)
*B41J 2/175* (2006.01)

(52) U.S. Cl. ..... 347/85; 347/7

(58) Field of Classification Search ..... 347/7, 85
See application file for complete search history.

(56) References Cited

U.S. PATENT DOCUMENTS

| | | | | |
|---|---|---|---|---|
| 5,448,274 | A | 9/1995 | Hirabayashi et al. | |
| 5,512,926 | A | 4/1996 | Uchikata et al. | |
| 2007/0109362 | A1 * | 5/2007 | Hori et al. | 347/65 |
| 2008/0198207 | A1 * | 8/2008 | Katada | 347/85 |
| 2008/0297569 | A1 * | 12/2008 | Umeda | 347/85 |
| 2009/0201347 | A1 * | 8/2009 | Hamano | 347/85 |

FOREIGN PATENT DOCUMENTS

| | | | | |
|---|---|---|---|---|
| JP | 2001-113716 | | 4/2001 | |
| JP | 2003-1846 | * | 1/2003 | 347/85 |
| JP | 2004-358918 | * | 12/2004 | 347/85 |

* cited by examiner

*Primary Examiner* — Julian Huffman
(74) *Attorney, Agent, or Firm* — Fitzpatrick, Cella, Harper & Scinto

(57) ABSTRACT

An ink jet printing apparatus having reduced manufacture costs is provided. The ink jet manufacturing apparatus includes a diaphragm section configured to be able to change the volume of a subtank, and an atmosphere communication port configured to allow the interior of the subtank to communicate with the atmosphere. The ink jet printing apparatus further includes an atmosphere communication valve configured to be able to close the atmosphere communication port, and a driving mechanism configured to drive the diaphragm section and the atmosphere communication valve. The driving mechanism opens the atmosphere communication port and then reduces the volume of the diaphragm section. The driving mechanism subsequently allows the atmosphere communication valve to close the atmosphere communication port and then increases the volume of the diaphragm section. The driving mechanism thus supplies the ink accommodated in a main tank to the subtank.

10 Claims, 10 Drawing Sheets

INK JET PRINTING APPARATUS AND METHOD FOR FILLING INK INTO INK TANK IN INK JET PRINTING APPARATUS

BACKGROUND OF THE INVENTION

1. Field of the Invention

The present invention relates to an ink jet printing apparatus configured to perform printing by ejecting ink to a print medium and a method for filling ink into an ink tank mounted in the ink jet printing apparatus.

2. Description of the Related Art

According to Japanese Patent Laid-Open No. 2001-113716, to eliminate the possible need to replace an ink tank during an operation of printing a print medium, a structure of an ink jet printing apparatus that uses a subtank separately from a main tank is described. In the ink jet printing apparatus disclosed in the specification, ink is supplied from the main tank, which is replaceable and has a large capacity, to the subtank, which has a relatively small capacity. The ink stored in the subtank is supplied to the print head.

Hence, even if the ink in the main tank is exhausted during printing of one print medium, a certain amount of ink still remains in the subtank. The ink stored in the subtank can be used to continue printing. Then, the printing operation can be achieved without interruption by completing replacement of the main tank while printing is being performed with ink supplied from the subtank. As a result, the quality of print images can be kept high.

In the printing apparatus disclosed in Japanese Patent Laid-Open No. 2001-113716, the print head and the subtank are mounted in a carriage. The main tank is located separately from the carriage, with an ink channel extending from the main tank to the subtank. The ink channel extending from the main tank to the subtank is allowed to contact and leave the subtank. A pump is located in the ink channel extending from the main tank, to supply ink from the main tank to the subtank.

However, the pump configured to supply ink from the main tank to the subtank is often expensive. In general, the pump requires arrangements such as a driving source, a transmission mechanism configured to transmit a driving force generated by the driving source, and the ink channel, and so on. Thus, the pump requires relatively high costs compared to the other components forming the printing apparatus. Moreover, the printing apparatus configured to supply ink from the main tank to the subtank requires an exhaust air mechanism. The exhaust air mechanism requires, for example, a valve configured to allow the subtank to communicate with the atmosphere and to break the communication between the subtank and the atmosphere and a driving mechanism for the valve, or the pump. The exhaust air mechanism may thus have a complicated and expensive configuration.

SUMMARY OF THE INVENTION

Thus, in view of the above-described circumstances, an object of the present invention is to provide an ink jet printing apparatus configured to perform printing by ejecting ink stored in a subtank from a print head, ink being supplied from a main tank to a subtank, the ink jet printing apparatus achieved reducing manufacture costs.

According to a first aspect of the present invention, there is provided an ink jet printing apparatus comprising: a print head configured to perform printing by ejecting ink supplied from a first ink tank removably mounted in a printing apparatus main body; a second ink tank configured to be able to temporarily store, between the first ink tank and the print head, ink supplied from the first ink tank to the print head; a volume changing member configured to be able to change volume of the second ink tank; an atmosphere communication port configured to enable an interior of the second ink tank to communicate with atmosphere; and a driving mechanism configured to control changing of the volume of the volume changing member and opening and closing of the atmosphere communication port, wherein, the driving mechanism opens the atmosphere communication port and then the volume changing member reduces the volume of the second ink tank, and subsequently closes the atmosphere communication port and then the volume changing member increases the volume of the second ink tank, thus the ink accommodated in the first ink tank is supplied to the second ink tank.

According to a second aspect of the present invention, there is provided a method for filling ink into a second ink tank in an ink jet printing apparatus, the ink jet printing apparatus comprising a print head configured to perform printing by ejecting ink supplied from a first ink tank removably mounted in a printing apparatus main body and the second ink tank configured to be able to temporarily store ink supplied from the first ink tank to the print head between the first ink tank and the print head, said method comprising: a step of opening an atmosphere communication port configured to allow interior of the second ink tank to communicate with atmosphere and then reducing volume of a volume changing member configured to be able to change volume of the second ink tank; and a step of closing the atmosphere communication port and then increasing the volume of the volume changing member.

The present invention provides an ink jet printing apparatus configured to perform printing by ejecting ink stored in a subtank from a print head, ink being supplied from a main tank to a subtank, the ink jet printing apparatus achieved reducing manufacture costs.

Further features of the present invention will become apparent from the following description of exemplary embodiments (with reference to the attached drawings).

DESCRIPTION OF THE EMBODIMENTS

Embodiments of the present invention will be described below with reference to the attached drawings.

First Embodiment

Figure 1:
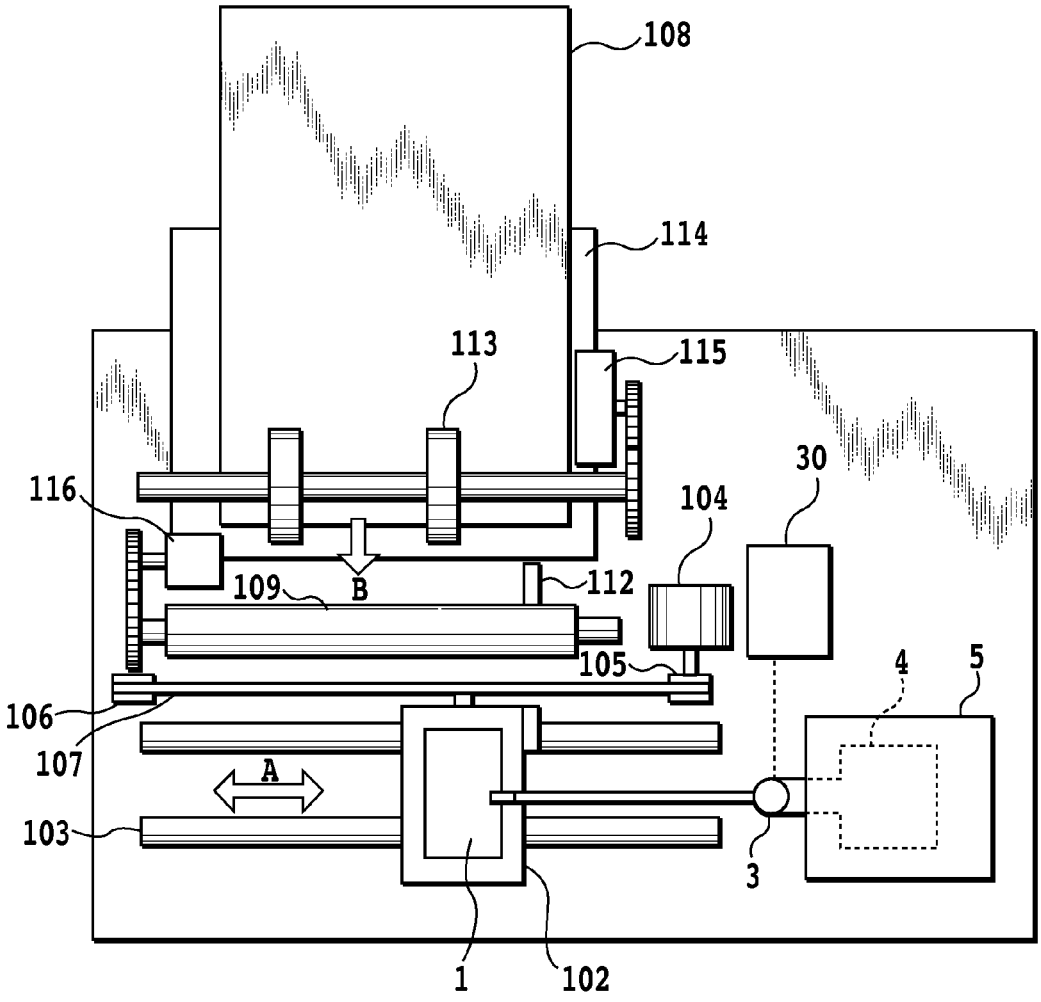
FIG. 1 is a plan view of an ink jet printing apparatus according to a first embodiment of the present invention.

FIG. 1 is a schematic plan view illustrating the general configuration of an ink jet printing apparatus to which a present invention is applied. The ink jet printing apparatus shown herein is of what is called a serial type in which a print head capable of ejecting ink droplets is moved in a direction crossing a direction in which a print medium is conveyed to perform printing.

In FIG. 1, the print head 1 is an ink jet print head capable of ejecting supplied ink through a plurality of ejection ports, and is removably mounted in a carriage 102. The carriage 102 includes a connector holder (electric connection section) configured to transmit driving signals and the like to the print head 1 via a connector (not shown in the drawings). The carriage 102 is supported by a guide shaft 103 installed in the apparatus main body, so as to be able to reciprocate in a main scanning direction shown by arrow A. A timing belt 107 connected to the carriage 102 is passed between a motor pulley 105 and a driven pulley 106 both rotationally driven by a main scanning motor 104. The carriage 102 is moved in the main scanning direction by a driving mechanism comprising the motor 104, the pulleys 105 and 106, and the timing belt 107.

Print media 108 such as print sheets or thin plastic plates or the like are separately fed one by one from an auto sheet feeder (ASF) 114 by rotation of a pickup roller 113 driven by a sheet feeding motor 115. Moreover, the print medium 108 is conveyed in a sub-scanning direction shown by arrow B, by rotation of a conveying roller 109. The print medium 108 thus passes through a position (printing section) located opposite a surface (ejection port surface) of the print head 1 in which ejection ports are formed. The conveying roller 109 is drivingly rotated by the conveying motor 116. The following are performed based on sensing signals from a paper end sensor 112 located upstream of the conveying roller 109: determination of whether or not the print medium 108 has been supplied and setting the front end of the print medium during supplying. The back surface of the print medium 108 is supported by a platen (not shown in the drawings) so that the print medium forms a flat print surface in the printing section.

The ink jet printing apparatus configured as described above forms an image on the print medium by repeating a print scan in which the print head 1 ejects ink while performing a scan in the direction of arrow A together with the carriage 102 and a conveying operation performed between scans by the print head.

Figure 2:
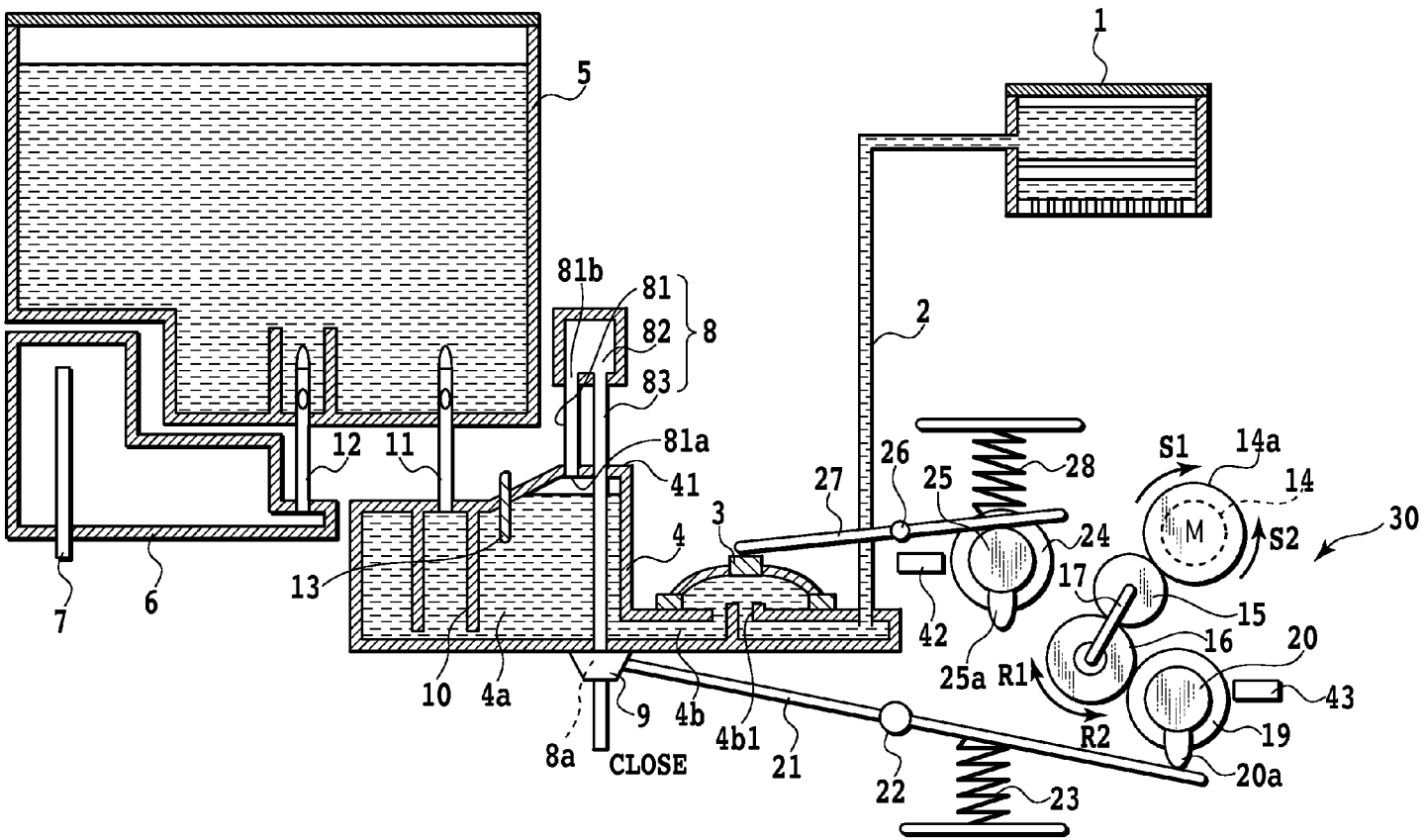
FIG. 2 is a sectional view of an ink supply system configured to supply ink to a print head, showing that a diaphragm section has been expanded.

FIG. 2 is a schematic diagram of an ink supply system in the ink jet printing apparatus 100 according to the first embodiment of the present invention. For simplification, only a path for ink as a liquid in one color is shown. FIG. 2 particularly shows that a sufficient amount of ink is accommodated inside a main tank 5 and that printing is performed using the ink in the main tank 5.

First, the configuration of the ink supply system according to the present embodiment will be described. The ink supply system according to the first embodiment includes the print head 1, the main tank 5, a subtank 4, and a buffer chamber 6. The print head 1 comprises an element substrate including print elements provided thereon to allow ink to be ejected, and an orifice plate joined to the element substrate. The orifice plate includes a plurality of ejection ports through which ink droplets are ejected, a bubbling chamber configured to communicate with the ejection ports when the bubbling chamber is joined to the element substrate, the bubbling chamber serving as an energy generation chamber, and an ink channel configured to communicate with the bubbling chamber. The print elements are driven to eject ink through the ejection ports.

The main tank (first ink tank) 5 is removably mounted in the printing apparatus main body. In the present embodiment, the main tank 5 is formed to be able to accommodate a relatively large amount of ink. The ink accommodated in the main tank 5 is supplied to the subtank 4 mounted in the printing apparatus main body. Moreover, ink in the subtank is supplied to the print head 1 mounted in the carriage. The print head 1 ejects the supplied ink through the ejection ports to print an image. As the printing operation progresses, ink is supplied from the main tank 5 to the subtank 4, with the amount of ink in the main tank decreasing. When the ink in the main tank 5 is exhausted or the amount of ink in the main tank 5 is insufficient to print one print medium, the main tank 5 is replaced with a new main tank with ink filled therein.

The subtank (second ink tank) 4 can store ink temporarily, between the main tank 5 and the print head 1, ink supplied from the main tank 5 to the print head 1. An amount of ink sufficient to enable a printing operation during a replacement operation for the main tank 5 is accommodated in the subtank 4 so as to avoid interrupting the printing operation. Thus, the capacity of the subtank 4 is set to be relatively smaller than that of the main tank 5. Separation of the subtank 4 from the main tank 5 enables image quality to be prevented from being degraded by the interruption of the printing operation during the replacement of the main tank 5. The main tank 5 and the subtank 4 are allowed to communicate through a first hollow pipe 11 projected from the top surface of a liquid chamber in the subtank 4. The first hollow pipe 11 is formed of a conductive member such as metal, and ink can flow through the pipe 11.

Here, the first hollow pipe 11 is formed to have a sufficiently small inner diameter so as to allow the channel through which ink flows to offer sufficient channel resistance to the ink. Thus, even if the main tank 5 is located above the subtank 4, the ink accommodated in the main tank 5 is prevented from being supplied into the subtank 4 only by gravity. When the print head 1 ejects ink to reduce the amount of ink in the subtank 4, thus allowing generation of a negative pressure of at least a predetermined value in the subtank 4, then the ink is supplied from the main tank 5 to the subtank 4.

Furthermore, a supply tube 2 is located between the print head 1 and the subtank 4 to connect the print head 1 and the subtank 4 together. The supply tube 2 enables ink to flow through therein and allow the ink inside the subtank 4 to be supplied to the print head 1. The supply tube 2 is formed of a flexible material and enables ink to be supplied to the print head 1 during scanning.

An atmosphere communication path 8 is coupled to the subtank 4 so as to allow air to flow between the subtank 4 and the exterior so that the interior and the atmosphere can communicate. The atmosphere communication path 8 comprises an entry section 81, a space section 82, and a discharge section 83. The entry section 81 is formed to extend upward from the highest position 41 in the subtank 4. The space section 82 is coupled to an outlet 81*b* formed at the upper end of the entry section 81. The discharge section 83 is formed to extend downward from the space section 82 to below the bottom surface of the subtank 4. The atmosphere communication path 8 is shaped generally like an inverted letter U. An inlet 81*a* formed at the lower end of the entry section 81 is disposed at the same height position as the highest position in the subtank 4. Furthermore, an atmosphere communication valve 9 is provided in the discharge section 83 of the atmosphere communication path 8 so as to be slidable along the outer peripheral surface of the discharge section 83. Moving the atmosphere communication valve 9 enables the atmosphere communication port 8*a*, the outlet of the atmosphere communication path 8, to be opened and closed. Hence, when the atmosphere communication port 8*a* is open, the air inside the subtank 4 can be emitted to the exterior via the entry section 81, the space section 82, and the discharge section 83.

Furthermore, a solid pipe 13 formed of a conductive material such as metal or the like is attached to the subtank 4 so as to contact the ink in the subtank 4 when the liquid surface of the ink is at least at a predetermined height. The solid pipe 13 and the hollow pipe 11 are electrically connected together by a wiring section (not shown in the drawings). Thus, when the solid pipe 13 and the hollow pipe 11 come into contact with the ink stored in the subtank, a closed circuit is formed to allow outputting of an electric signal indicating that ink has been filled into the subtank.

In the present embodiment, the solid pipe 13 is located in an inclined surface formed in the top surface of the subtank 4. This avoids the collection, around the solid tube 13, of bubbles generated in the ink in the subtank 4. Hence, possible misdetection can be avoided in which even though the liquid surface has reached the position where the ink comes into contact with the solid tube 13, bubbles collected around the solid tube 13 prevent the contact of the ink with the solid tube 13 and thus the detection of the position of the liquid surface.

Figure 3:
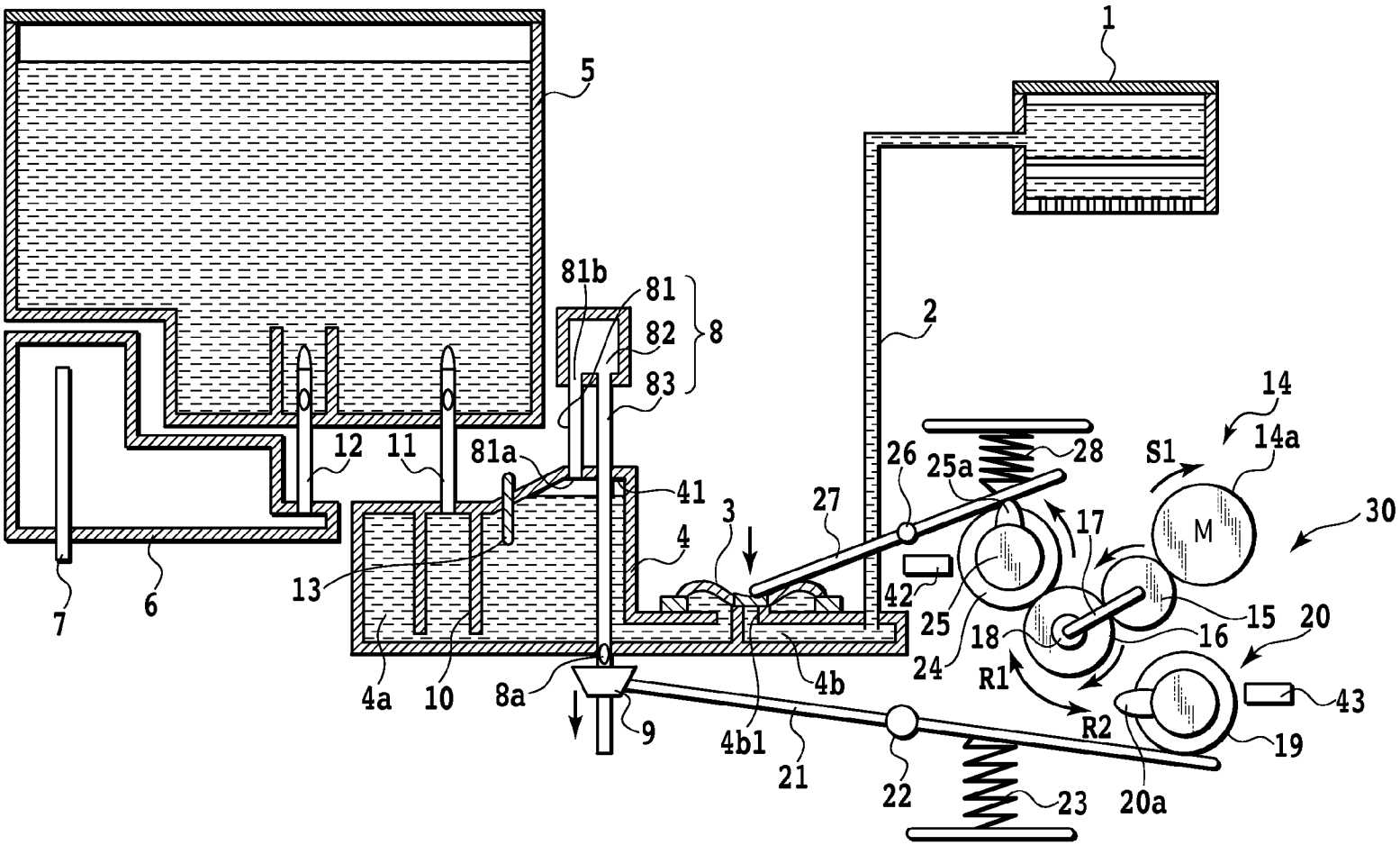
FIG. 3 is a sectional view of the ink supply system configured to supply ink to the print head, showing that the diaphragm section has been contracted.

Furthermore, the diaphragm section 3 is provided on a part of a wall surface forming the subtank 4 to enable the volume of the subtank 4 to be varied. In the present embodiment, the subtank 4 comprises a liquid chamber section 4*a* and a channel section 4*b* configured to communicate with the liquid chamber section 4*a*. The diaphragm section 3 is provided on the channel section 4*b*. The diaphragm section 3 is formed of a flexible rubber. FIG. 2 shows an initial condition in which the diaphragm section 3 bulges outward from the wall surface of the channel section 4*b*; the volume of the subtank 4 has been increased. On the other hand, FIG. 3 shows that a central portion of the diaphragm section 3 has been pressed to a position where the central portion comes into contact with the wall surface of the channel section 4*b*. In this condition, the volume of the subtank 4 is smaller than that in the above-described expanded condition. A communication port 4*b*1 configured to be opened and closed by the diaphragm section 3 is formed in the channel section 4*b* according to the present embodiment. Furthermore, the lower end of the above-described supply tube 2 is coupled to a portion of the channel section 4*b* located downstream of the communication port 4*b*1 (downstream in the direction in which ink is supplied from the subtank to the print head). Hence, with the diaphragm section 3 pressed as shown in FIG. 3, the communication port 4*b*1 is closed by the diaphragm section 3 to break the communication between the liquid chamber section 4*a* and the print head 1. That is, the diaphragm section 3 also functions as an on-off valve configured to allow the print head and the liquid chamber section 4*a* to communicate and to break the communication between the print head and the liquid chamber section 4*a*.

Furthermore, the channel section 4*b* with the diaphragm section 3 provided therein is located below the liquid chamber section 4*a* of the subtank 4. A communication port between the channel section 4*b* and the liquid chamber section 4*a* is formed at a relatively low position in the subtank 4. This prevents air from flowing into the channel section 4*b* and the diaphragm section 3 until the ink is consumed to reduce the amount of ink remaining in the subtank to a very small value.

The buffer chamber 6 is formed as a container inside which ink can be accommodated and to communicate with the main tank 5. An atmosphere communication path 7 that is open to the atmosphere is located inside the buffer chamber 6. The main tank 5 and the buffer chamber 6 are connected together by a second hollow pipe 12. The second hollow pipe 12 is formed of a conductive member such as metal so that ink can flow through the second hollow pipe 12. Since the main tank 5 and the buffer chamber 6 are in communication, even if an increase in temperature causes the ink inside the main tank 5 to be expanded to increase the pressure inside the main tank 5, the ink inside the main tank 5 can be allowed to flow into the buffer chamber 6. This inhibits the pressure inside the main tank 5 from increasing excessively. Furthermore, the main tanks is formed to communicate with the atmosphere via the buffer chamber 6. Consequently, the buffer chamber 6 serves to balance the pressure inside the main tank 5 with the atmospheric pressure.

Now, a mechanism configured to press and open the diaphragm section 3 and to perform open and close operation of the atmosphere communication port will be described. In the present embodiment, a driving mechanism 30 with the same motor 14 presses and opens the diaphragm section 3 to reduce and increase operation of the volume of the subtank 4 and open and close operation of the atmosphere communication port. The driving mechanism 30 comprises the motor 14 and a driving force transmitting mechanism composed of a driving gear 14*a* fixed to an output shaft of the motor 14, an idle gear 15, and a planetary gear 16. The driving mechanism 30 also includes a first gear 19 and a second gear 24 selectively rotationally driven by the driving force transmitting mechanism, a first cam 20 rotated integrally with the first gear, and a second cam 25 rotated integrally with the second gear 24 atmosphere valve lever.

More specifically, the driving gear 14*a* fixed to the output shaft of the motor 14 is located so as to mesh with the idle gear 15. Furthermore, the idle gear 15 and the planetary gear 16 mesh with each other and each transmit the driving force of the motor 14. The planetary gear 16 is connected to the idle gear 15 via the arm 17. The planetary gear 16 can move in a direction R1 or R2 depending on the rotating direction of the motor 14 shown in FIG. 2, with keeping a distance between the planetary gear 16 and the center shaft of the idle gear 15. Upon moving in the direction R1, the planetary gear 16 can mesh with the second gear 24. Upon moving in the direction R2, the planetary gear 16 can mesh with the first gear 19.

Moreover, the driving mechanism 30 further includes an atmosphere valve lever 21 configured to rotate using a supporting point 22 as a center shaft and a diaphragm lever 27 configured to rotate using a supporting point 26 as a center shaft. One end of the atmosphere valve lever 21 is coupled to the atmosphere communication valve 9 configured to open and close the above-described atmosphere communication port 8*a*. The atmosphere valve lever 21 is biased by the bias force of a compression spring 23 to the position where the atmosphere communication port 8*a* is opened. A pressing section 20*a* projecting outward is provided on apart of the outer periphery of the first cam 20. The first cam 20 rotates to a predetermined phase position to allow the pressing section

20*a* to press one end of the atmosphere valve lever 21 against the bias force of the compression spring 23. Furthermore, the second cam 25 rotates to a predetermined phase position to allow the pressing section 25*a* to press the diaphragm lever 27 against the force of the compression spring 28. Atmosphere valve sensor 43 and Diaphragm section sensor 42 are arranged close to the first gear 19 and the second gear 24, respectively to sense the phases of the first cam 20 and the second cam 25, which rotate in conjunction with the first gear 19 and the second gear 24, respectively. The diaphragm section sensor 42 senses the phases of the second cam 25, which allows the pressing section 25*a* to press the diaphragm lever 27, which operates the diaphragm section 3. Furthermore, the atmosphere valve sensor 43 senses the phases of the first cam 20, which allows the pressing section 20*a* to press the atmosphere valve lever 21, which operates the atmosphere communication path 9. The atmosphere valve sensor 43 and the diaphragm section sensors 42 accurately detect the phases of the first gear 19 and the second gear 24 to reliably enable the operation of opening and closing the atmosphere communication port and the operation of moving the diaphragm section 3 to increase and reduce the volume of the subtank 4. In the present embodiment, the diaphragm section sensor 42 and atmosphere valve sensor 43 are optical photo sensors including a light emitting element and a light receiving element. In the present embodiment, flags are provided at predetermined positions on the first gears 19 and the second gear 24. When the flag is positioned at a predetermined phase, light from the light emitting element is blocked. Thus, the phase of the first gear 19 and the second gear 24 is sensed. The aspect of the diaphragm section sensor 42 and the atmosphere valve sensor 43 is not limited to the one described above. Magnetic sensors may be used which detect a change in magnetic field caused by the passage of the gear by the sensor.

Figure 9:
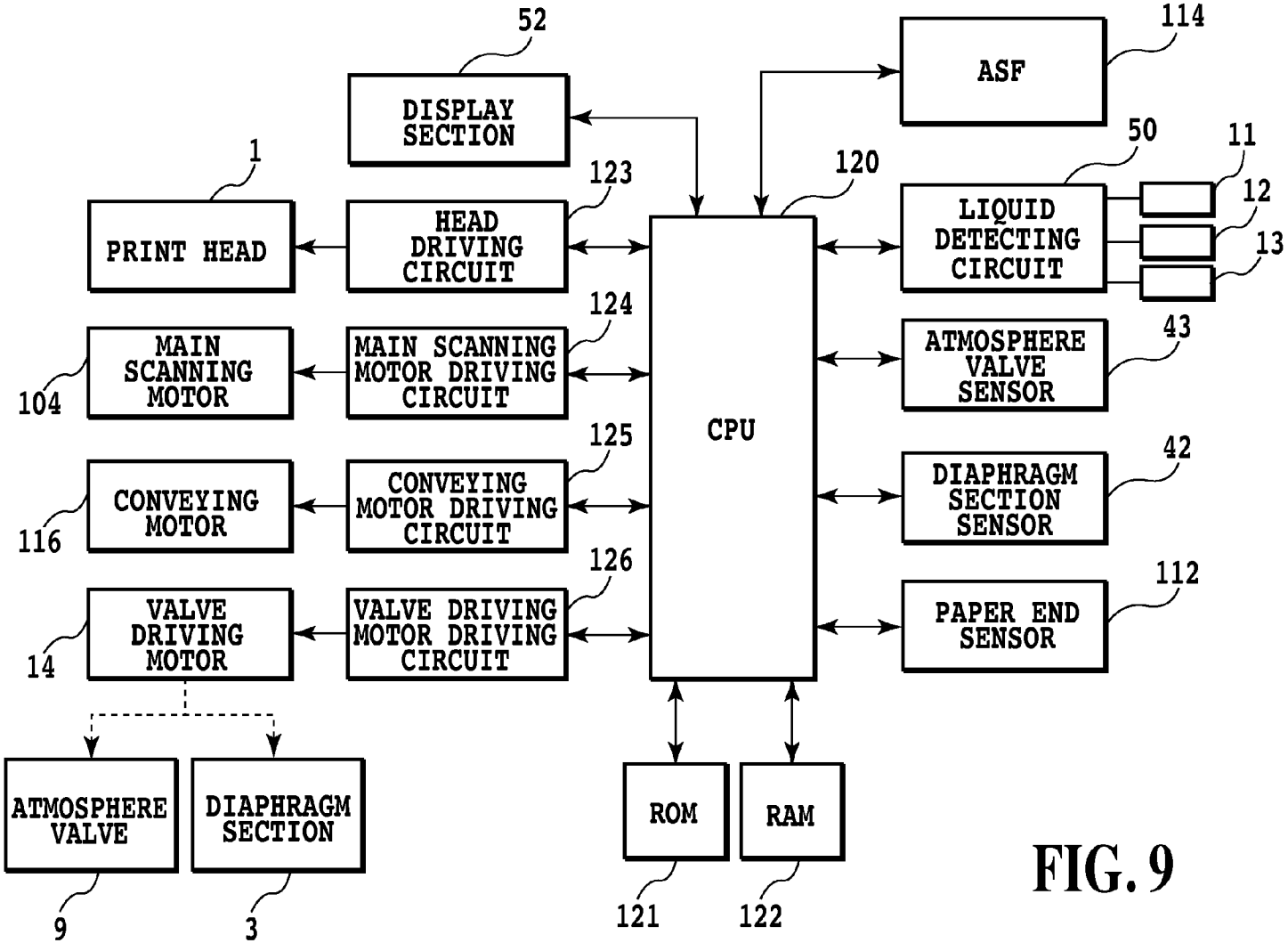
FIG. 9 is a block diagram of a control system of the ink jet printing apparatus.

FIG. 9 is a block diagram of a control system of the ink jet printing apparatus according to the present embodiment. In FIG. 9, the operations of the sections of the ink jet printing apparatus are controlled by a CPU 120 based on control programs stored in a ROM 121 and various data stored in a RAM 122. That is, the CPU 120 connects to a head driving circuit 123 to drive electrothermal conversion elements provided in the print head 1, a main scanning motor driving circuit 124 configured to drive a main scanning motor 104, a conveying motor driving circuit 125 configured to drive a conveying motor 116, and the like. The above-described motor 4 is also connected to the CPU 120; the motor 4 is a driving source configured, for example, to open and close the atmosphere valve 9 and to move the diaphragm section 3. The CPU 120 further connects to, for example, a display section 52 configured to display the operating status of the ink jet printing apparatus, and an ASF 114 configured to supply print media. The CPU 120 further connects to, for example, the above-described atmosphere valve sensor 43, diaphragm section sensor 42, and paper end sensor 112. The CPU 120 further connects to a liquid detecting circuit 50 configured to output a signal indicating whether or not the amount of ink accommodated in the main tank 5 and in the subtank 4 has reached a predetermined value or smaller. The liquid detecting circuit 50 applies predetermined voltages to between the above-described first hollow pipe 11 and second hollow pipe 12 and to between the above-described first solid pipe 11 and solid pipe 13. The liquid detecting circuit 50 determines whether or not a current has flowed between the first hollow pipe 11 and the second hollow pipe 12 and between the first hollow pipe 11 and the solid pipe 13. If a current has flowed between the first hollow pipe 11 and the second hollow pipe 12 and between the first hollow pipe 11 and the solid pipe 13, the liquid detecting circuit 50 outputs a detection signal to the CPU 120. The liquid detecting circuit 50, the hollow pipes 11 and 12, and the solid pipe 13 form liquid detecting means for determining whether or not ink is present in the main tank and the subtank.

Furthermore, in the above-described control system, in response to signals output by the liquid detecting circuit 50 and the sensors for the respective sections, the CPU 120 controls various operations such as a printing operation and an operation of filling ink into the subtank in accordance with the control programs stored in the ROM 121. For example, in the operation of filling ink into the subtank after replacement of the main tank 5, signal indicative of the phases of the first cam 20 detected by the atmosphere valve sensor 43 is input to the CPU 120. Further, signal indicative of the phases of the second cam 25 detected by the diaphragm section sensor 42 is input to the CPU 120. Based on the phases and a signal from the liquid detecting circuit 50, the CPU 120 controls the rotating direction and rotation amount of the motor 14.

When the print head 1 of the ink jet printing apparatus 100 configured as described above ejects ink, and ink is consumed as a result of ejection of ink, a negative pressure is generated in the print head 1. At this time, since the atmosphere communication valve 9 is closed, the negative pressure propagates into the subtank 4 without escaping to the exterior. Then, since the main tank 5 and the subtank 4 are in communication via the first hollow pipe 11 as described above, the negative pressure formed in the subtank 4 allows the ink to be supplied from the main tank 5 to the subtank 4. Furthermore, in the present embodiment, the main tank 5 and the buffer chamber 6 are in communication via the second hollow pipe 12 as described above. The air inside the buffer chamber 6, which is in communication with the exterior through the atmosphere communication path 7, can flow into the main tank 5. Hence, even if the amount of ink inside the main tank 5 decreases as a result of the above-described printing, the pressure in the main tank 5 is prevented from decreasing excessively.

In the present embodiment, since the interior of the first hollow pipe 11 has sufficiently high resistance, only an amount of ink corresponding to the consumption in the print head is supplied from the interior of the main tank 5 to the subtank 4. Thus, the level of the ink in the subtank 4 is adjusted to within a given range. In the present embodiment, with ink accommodated in the main tank 5, the level of the ink inside the subtank 4 is adjusted to between the lower end of the solid pipe 13 and the top surface of the subtank 4.

Figure 4:
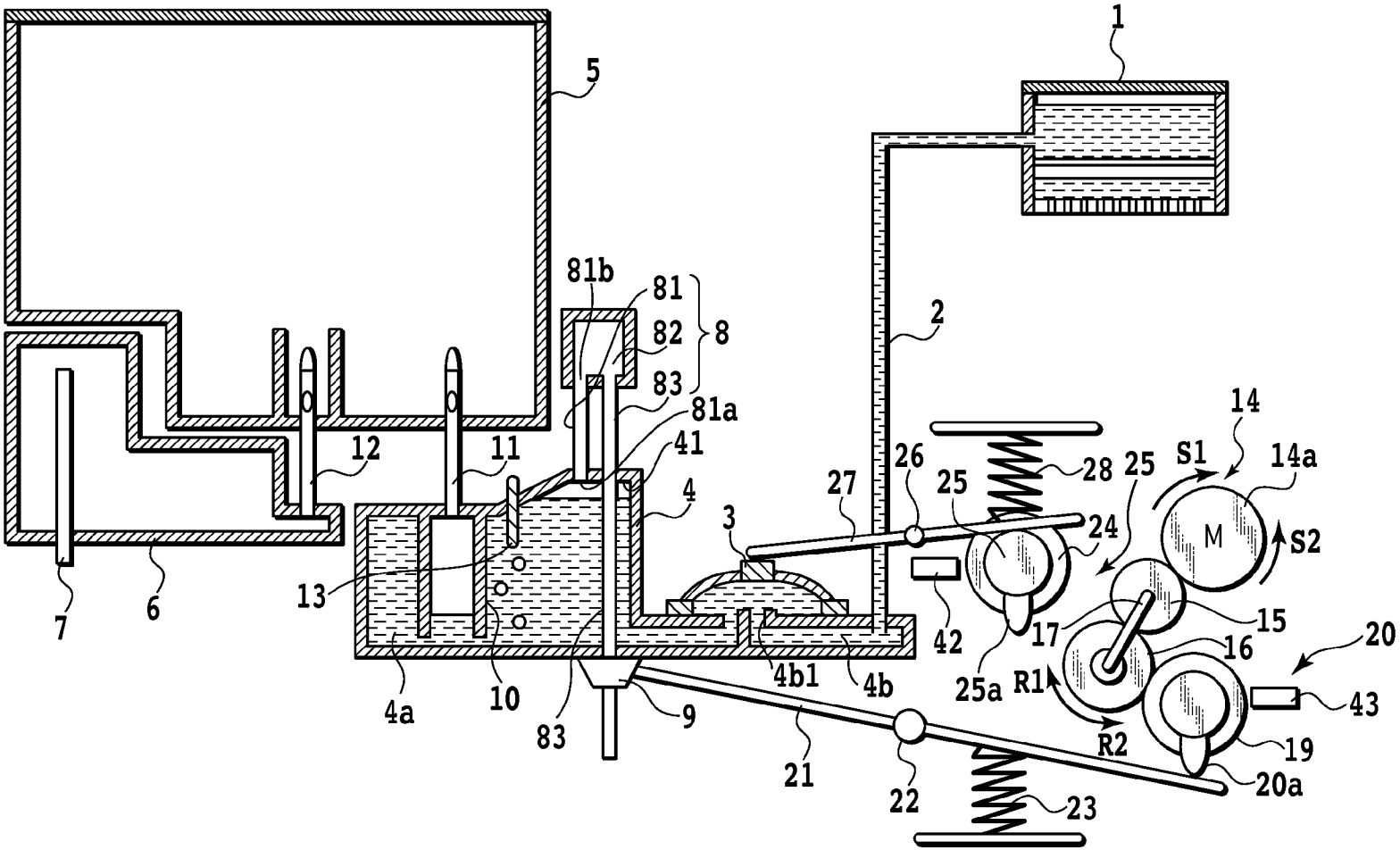
FIG. 4 is a sectional view of the ink supply system showing that ink in a main tank has been exhausted and air has been supplied in a subtank.

When the ink inside the main tank 5 is exhausted, air is supplied from the main tank 5 to the subtank 4. Hence, as shown in FIG. 4, as the ink continues to be ejected from the print head 1 after the main tank 5 has become empty, air is supplied into a supply path 10 in the subtank 4. The air flows into the supply path 10 in the subtank 4 via the first hollow tube 11, which couples the main tank 5 and the subtank 4 together.

In the present embodiment, a predetermined voltage is applied to between the hollow pipe 11 and the solid pipe 13. Then, depending on whether or not electric continuity is established between the hollow pipe 11 and the solid pipe 13, the apparatus determines whether or not ink remains in the supply path 10. At this time, if ink is present in the supply path 10 entirely, electric continuity is established between the hollow pipe 11 and the solid pipe 13. If ink is not present in any area of the supply path 10, electric continuity is not established between the hollow pipe 11 and the solid pipe 13. The electric continuity allows the apparatus to determine whether or not ink is accommodated in the supply path 10 and thus whether or not ink is present in the main tank 5. For example, when the hollow pipe 11 and the solid pipe 13 are electrically disconnected from each other, the apparatus determines that the ink inside the subtank 4 has started to be consumed. At this time, it is expected that no ink is present inside the main tank 5, which is thus empty, and that the air in the main tank 5 has been flowed into the supply path 10 in the subtank 4. The hollow pipe 11 has an inner diameter of ϕ1.6 mm, and the supply path 10 has an inner diameter of ϕ2 mm to ϕ3 mm, in order to allow the apparatus to more accurately determine whether or not ink is present in the main tank 5. Since the wall surface forming the supply path 10 is shaped like a cylinder with a small inner diameter, when air is supplied into the subtank 4 to lower the liquid surface of the ink, the liquid surface is relatively significantly displaced. Hence, when air is supplied into subtank 4, amount of the moving of liquid surface of the ink is large. Thus, even when only a small amount of air flows from the main tank 5 into the subtank 4, the electric conduction between the hollow pipe 11 and the solid pipe 13 can be reliably interrupted. Since the ink jet printing apparatus has such construction, the exhaustion of the ink in the main tank 5 can be reliably detected based on the displacement of the liquid surface of the ink. Thus, an ink presence sensor (liquid presence sensor) is attached to the inside of the subtank 4 at a position close to a supply port through which the ink from the main tank 5 is supplied. The ink presence sensor determines whether or not ink is present to sense when the supplying of ink from the main tank 5 is stopped. In the present embodiment, since the hollow pipe 11 functions both as the supply port for the ink from the main tank 5 and as the ink presence sensor, the position of the supply port for the ink from the main tank 5 aligns substantially with the position where whether or not ink is present is sensed.

Once the exhaustion of the ink in the main tank 5 is detected as a result of detection of whether or not ink is present in the supply path 10 in the subtank 4, the amount of ink consumed by the print head 1 is calculated based on the number of times that the ink has been ejected. Then, based on the amount of ink consumed, the amount of ink remaining in the subtank 4 is calculated. Thereafter, if printing is continued with the main tank 5 not replaced, when the subtank 4 becomes empty, the printing is interrupted. Then, an alarm operation is performed to urge a user to replace the main tank 5 with a new one.

When the exhaustion of the ink inside the main tank 5 is sensed, this is indicated on a display of the host computer or the display section of the printing apparatus to let the user know the exhaustion.

To replace the main tank 5, the user pulls the main tank 5 upward and out from the first hollow pipe 11 and the second hollow pipe 12. Then, a new main tank 5 is installed so that the first hollow pipe 11 and the second hollow pipe 12 penetrate the wall surface of the main tank 5. The subtank 4 and the buffer chamber 6 are connected to the main tank 5.

In the present embodiment, a predetermined voltage is applied to between the first hollow pipe 11 and the second hollow pipe 12. Then, depending on whether or not electric continuity is established between the first hollow pipe 11 and the second hollow pipe 12, the apparatus can determine whether or not the main tank 5 is installed, in which the main tank 5 is filled with ink. Thus, in the present embodiment, a main tank installation sensor (first main tank installation sensor) is mounted in the apparatus to sense that the main tank 5 filled with ink has been installed.

Figure 5:
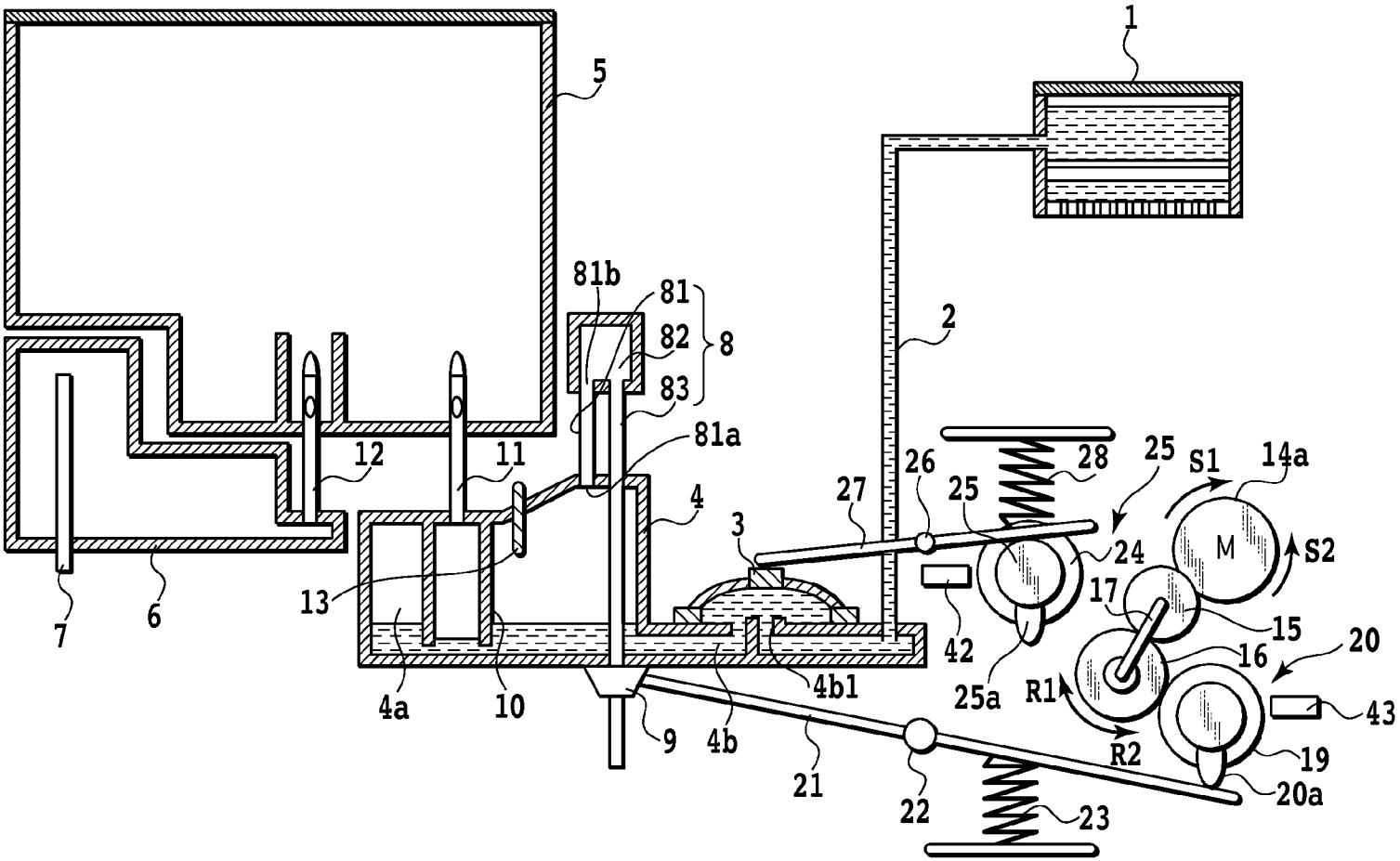
FIG. 5 is a sectional view of the ink supply system showing that the ink in the main tank has been exhausted and the ink in the subtank has been reduced.

FIG. 5 is a diagram showing that in the state shown in FIG. 4, the printing operation further progresses to consume and reduce the ink in the subtank 4. While the printing operation is being performed, the apparatus is in the initial state in which the atmosphere communication valve 9 is closed, with the diaphragm section 3 bulging outward. At this time, the internal volume of the subtank 4 is kept larger.

Figure 6:
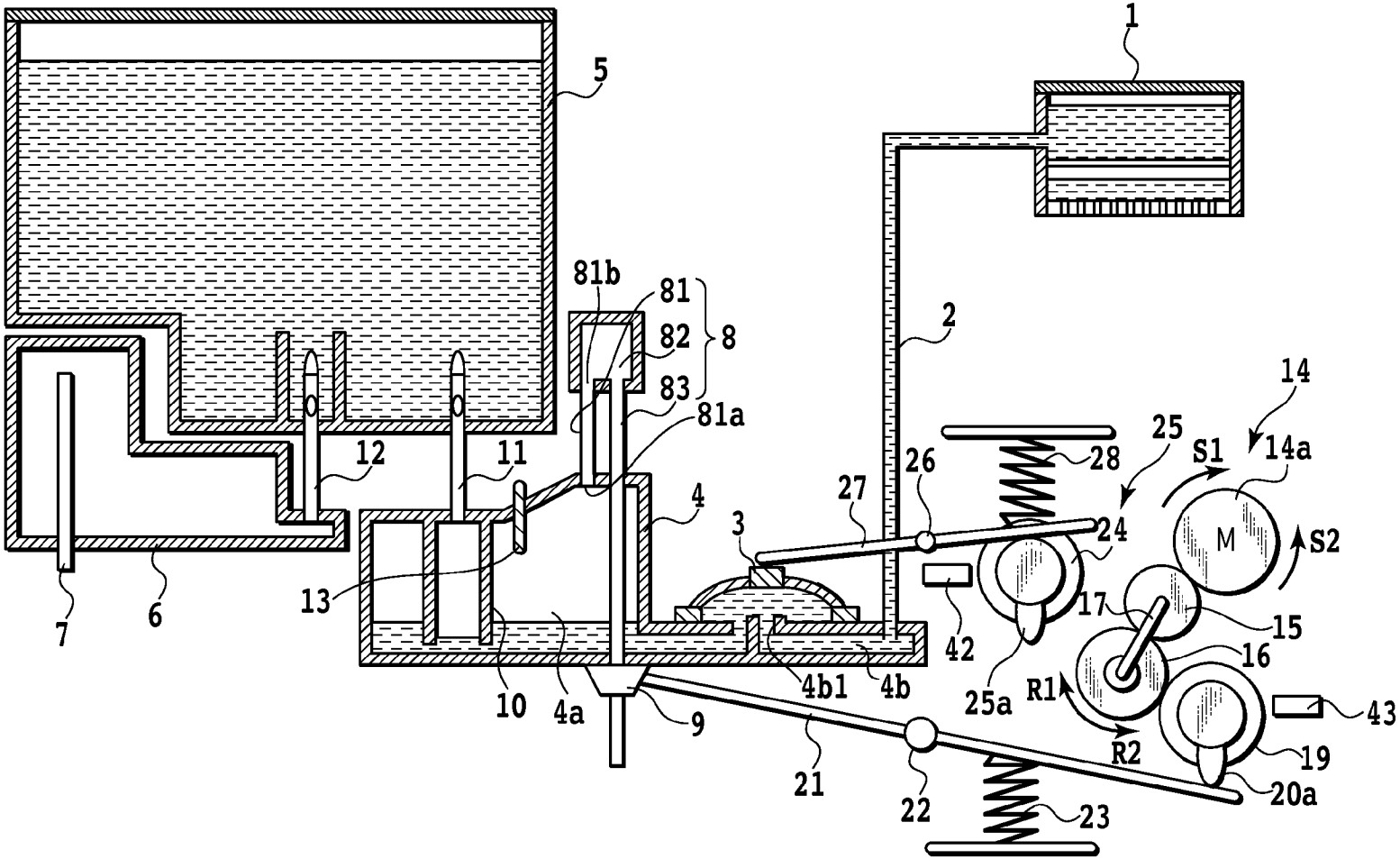
FIG. 6 is a sectional view of the ink supply system showing that a new main tank has been installed in the ink supply system.

The main tank 5 is located above the subtank 4. However, even when the main tank 5 with ink accommodated therein is mounted in the apparatus, the ink is not immediately supplied into the subtank 4. Normally, when the main tank 5 is replaced new one, this main tank 5 has been empty. Thus, as shown in FIG. 6, when the main tank 5 is replaced, air has been flowed into the supply path 10 in the subtank 4 from the empty main tank 5. Hence, normally, when the main tank 5 is replaced, the air is present in the supply path 10 in the subtank 4.

Furthermore, when the main tank 5 is replaced, the atmosphere communication valve 9 is closed. Furthermore, air is accommodated above the ink in the subtank 4. Thus, even when the main tank 5 is replaced to allow the main tank 5 with ink accommodated therein to communicate with the subtank 4, the air is prevented from being discharged from the subtank 4. Consequently, almost no ink flows into the subtank 4. Thus, even when the main tank 5 is replaced, no ink is supplied from the main tank 5 unless a negative pressure is generated in the subtank 4.

Thus, to supply ink to the subtank 4, it is necessary to generate a negative pressure in the subtank 4 to substitute the air in the subtank 4 with the ink in the newly replaced main tank 5, thus filling the ink into the subtank 4.

Figure 7A:
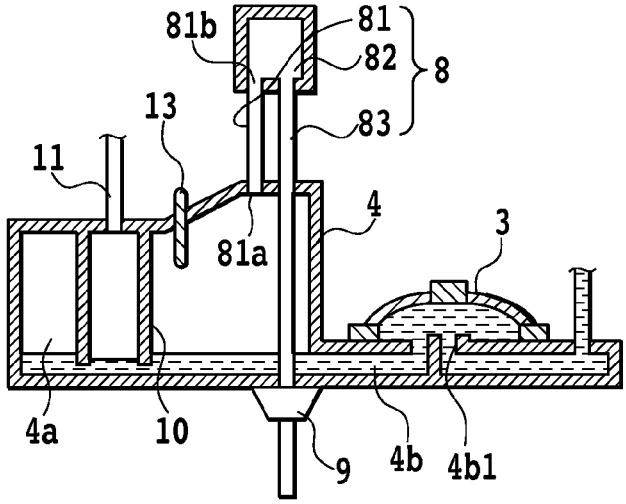
FIGS. 7A to 7C are enlarged sectional views of the subtank observed when the diaphragm section is expanded and contracted with an atmosphere communication port closed and opened.
Figure 7B:
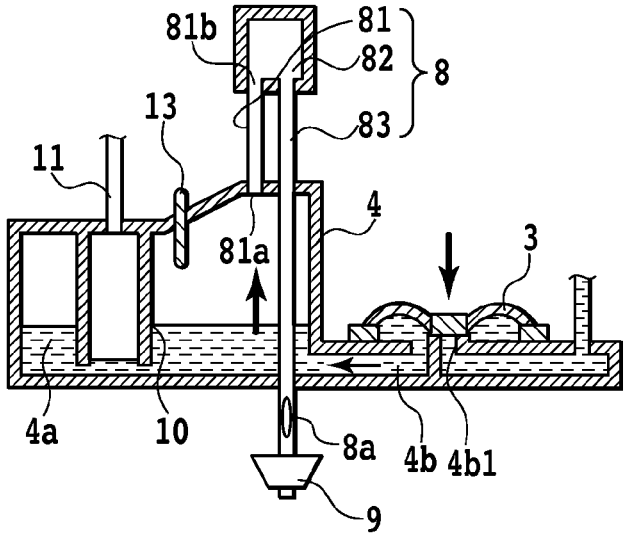
Figure 7C:
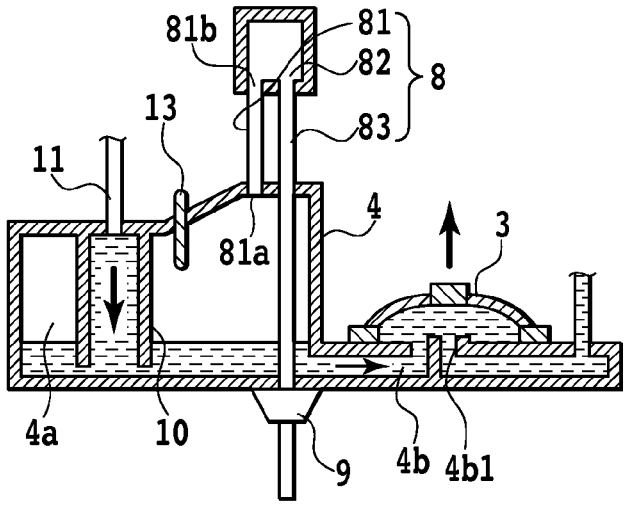
Figure 8:
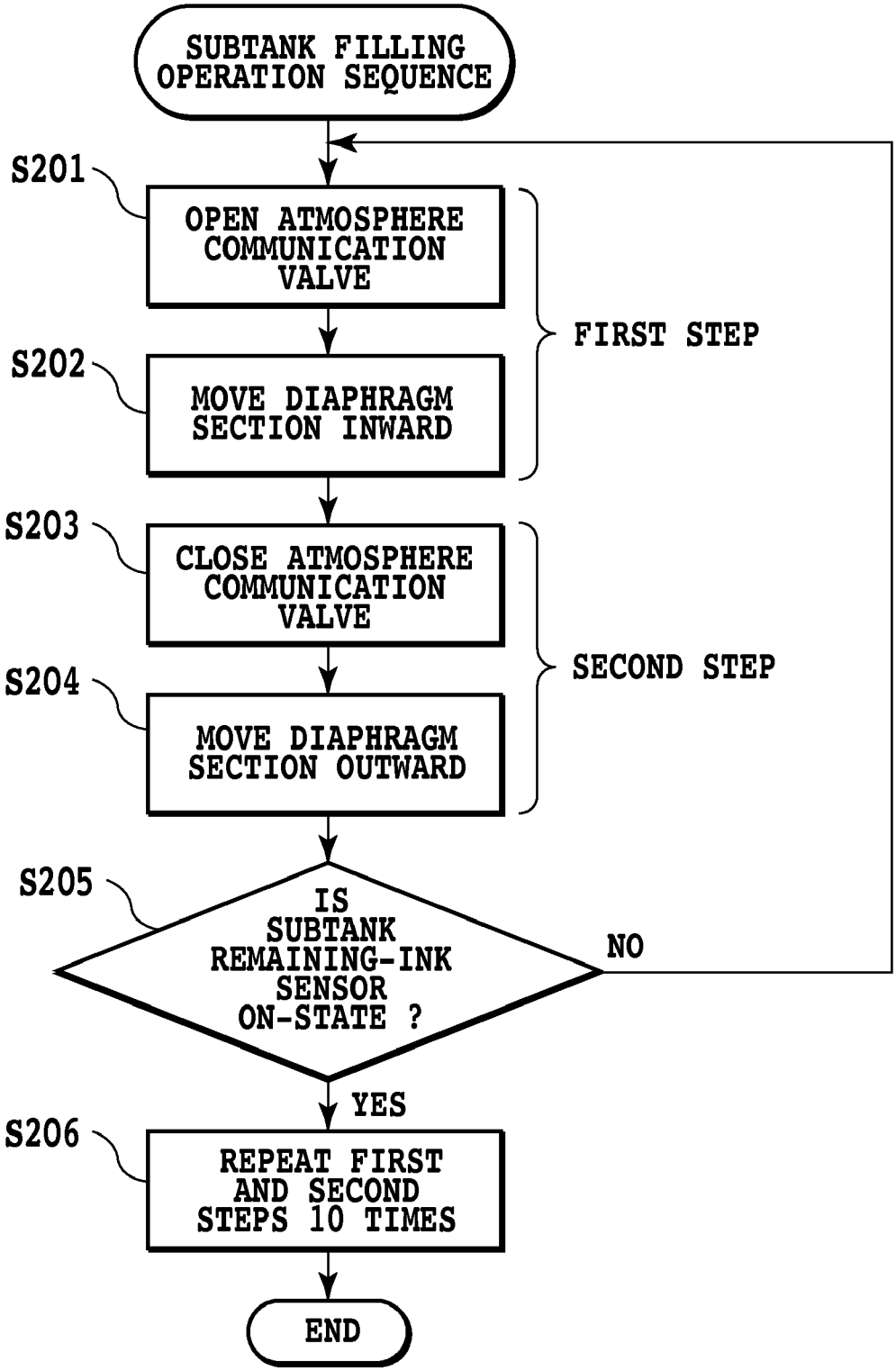
FIG. 8 is a flowchart showing steps of filling ink.

The operation of filling ink into the subtank will be described in brief with reference to FIGS. 7A to 7C and 8. FIGS. 7A to 7C are diagrams illustrating the operations of the subtank and the surrounding sections which operations are performed to fill ink into the subtank. FIG. 8 is a flowchart showing control steps for the operation of filling ink into the subtank as shown in FIGS. 7A to 7C.

FIG. 7A shows that with the main tank 5 replaced with a new one, the amount of ink in the subtank has decreased to a very small value. FIG. 7B shows that the diaphragm section 3 has been moved inward to discharge the air in the subtank 4 to the exterior of the subtank 4. FIG. 7C shows that the diaphragm section 3 has been moved outward to supply the ink from the main tank 5 into the subtank 4.

As shown in FIG. 7A, immediately after replacement of the main tank 5, the diaphragm section 3 is bulged outward with the volume of the subtank 4 increased. At this time, the atmosphere communication valve 9 is closed. Then, as shown in FIG. 7B, the closed atmosphere communication valve 9 is opened (S201) from closed state. The diaphragm section 3 is then positioned inward to reduce the volume of the subtank 4 (S202). The movement of the diaphragm section 3 changes the volume of the subtank 4 by about 0.5 cc.

Moving the diaphragm section 3 inward allows about 0.5 cc of ink to be pushed out from the diaphragm section 3 toward the main tank side of the subtank 4. At this time, the channel resistance $\Delta P_H$ between the diaphragm section 3 and the print head 1 (the channel resistance in the supply tube 2) is overwhelmingly higher than that $\Delta P_S$ between the diaphragm section 3 and the subtank 4 (main tank 5). Consequently, at this time, almost no ink is pushed out toward the print head 1.

The channel resistance in the pipe can be expressed in terms of a pressure loss in the flow in the pipe as follows.

The pressure loss ΔP can be expressed by:

$$\Delta P = Q \times (128\mu\Delta L)/\pi d^4 \quad (1)$$

where Q denotes the flow rate of the ink, μ denotes the viscosity of the ink, ΔL denotes the length of the channel, and d denotes the inner diameter of the channel.

In the present embodiment, the supply tube 2 has an inner diameter of ϕ2.4 mm and a length of about 1.9 m. On the other hand, when the subtank 4 is divided into the liquid chamber section 4*a* and a portion of the channel section 4*b* which extends from the diaphragm section 3 to the liquid chamber section 4*a*, the portion extending from the diaphragm section 3 to the liquid chamber section has an inner diameter of ϕ5 mm and a length of about 10 mm. In this case, the ratio of the resistance $\Delta P_H$ in the channel from the diaphragm section 3 to the print head 1 to the channel resistance $\Delta P_S$ in the channel section 4*b* in the subtank 4 which extends from the diaphragm section 3 is:

$$\Delta P_H:\Delta P_S=3580:1 \quad (2).$$

Thus, the resistance in the channel from the diaphragm section 3 to the print head 1 is overwhelmingly higher than that in the channel section 4*b* in the subtank 4 which extends from the diaphragm section 3.

Hence, even when the diaphragm section 3 moves to push the ink inside the subtank 4, almost none of the ink accommodated in the subtank 4 is pushed out toward the print head 1. As a result, the ink compressed and pushed out from the diaphragm section 3 as a result of the inward movement of the diaphragm section 3 moves toward the subtank 4.

Then, the resistance value $\Delta P_{H2}$ obtained when the ink flows into the main tank 5 via the supply path 10 in the subtank and the first hollow pipe 11 is compared with the resistance value $\Delta P_A$ obtained when the air in the subtank 4 is discharged to the atmosphere via the atmosphere communication path 8 in the subtank 4. In the present embodiment, the viscosity of the ink is about one hundredfold higher than that of air. Furthermore, the supply path 10 has an inner diameter of ϕ2 mm to ϕ3 mm and a length of about 20 mm. The first hollow pipe 11 has an inner diameter of ϕ1.6 mm and a length of about 30 mm. On the other hand, the atmosphere communication path 8 has an inner diameter of ϕ2.7 mm and a length of about 74 mm. Thus, the ratio of the resistance $\Delta P_{H2}$ in the channel from the subtank 4 to the main tank 5 to the resistance $\Delta P_A$ in the channel from the subtank 4 to the atmosphere via the atmosphere communication path 8 is:

$$\Delta P_{H2}:\Delta P_A=27.5:1 \quad (3).$$

As described above, the resistance $\Delta P_A$ in the channel from the subtank 4 to the atmosphere formed when the atmosphere communication valve 9 is open is overwhelmingly lower than that $\Delta P_{H2}$ in the channel from the subtank 4 to the main tank 5. Thus, when the diaphragm section 3 moves inward to reduce the volume of the subtank 4 to push the ink and air inside the subtank 4, the air in the subtank 4 is discharged to the atmosphere through the atmosphere communication valve 9. Consequently, the pressure in the subtank 4 is prevented from increasing, and almost no ink flows to the main tank 5.

Then, as shown in FIG. 7C, the open atmosphere communication valve 9 is closed (S203). The inwardly pressed diaphragm section 3 is moved to the initial state in which the diaphragm section 3 is bulged outward (S204). The movement of the diaphragm section 3 increases the volume of the subtank 4. Hence, a negative pressure is generated in the subtank 4 to allow about 0.5 cc of ink to flow into the diaphragm section 3. Furthermore, the ink flows from the main tank 5 to the subtank 4. At this time, since the resistance in the channel from the diaphragm section 3 to the print head 1 is considerably higher than that in the channel from the diaphragm section 3 to the main tank 5, almost no ink flows from the print head 1 into the diaphragm section 3. In the present embodiment, the supply path 10 has an inner diameter of ϕ2 mm to ϕ3 mm and a length of about 20 mm. The first hollow pipe 11 has an inner diameter of ϕ1.6 mm and a length of about 30 mm. Consequently, the ratio of the resistance $\Delta P_H$ in the channel from the diaphragm section 3 to the print head 1 to the resistance $\Delta P_T$ in the channel from the diaphragm section 3 to the main tank 5 is:

$$\Delta P_H:\Delta P_T=11:1 \quad (4).$$

Thus, the resistance in the channel from the diaphragm section 3 to the print head 1 is considerably higher. As a result, almost none of the ink present closer to the print head 1 flows into the diaphragm section 3. At this time, since the atmosphere communication valve 9 is closed, almost no air flows from the exterior of the printing apparatus into the subtank 4 via the atmosphere communication path 8. Then, a negative pressure is generated in the main tank 5. However, since air is introduced from the buffer chamber 6 into the main tank 5 via the atmosphere communication path 7, the negative pressure in the main tank 5 is eliminated. As a result, a given amount of ink is introduced from the main tank 5 into the subtank 4.

Now, description will be given of the operations of the components of the driving mechanism 30 performed when ink is supplied from the main tank 5 into the subtank 4 after replacement of the main tank 5 in the ink supply system according to the present embodiment.

As described above, the following are repeated to supply ink from the main tank 5 to the subtank 4 while removing air from the subtank 4 after replacement of the main tank 5: the operation of expanding and contracting the diaphragm section 3 (moving the diaphragm) and the operation of closing and opening the atmosphere communication valve 9. At this time, the diaphragm section 3 and atmosphere communication valve 9 in the printing apparatus may be in one of roughly two possible states. First, in one of the states, as shown in FIG. 2, the diaphragm section 3 is bulged outward of the subtank 4 to increase the volume of the diaphragm section 3 (this state is hereinafter referred to as a diaphragm section expanded state). Furthermore, the atmosphere communication valve 9 is closed. In the other state, as shown in FIG. 3, the diaphragm section 3 is pressed to reduce the internal volume thereof (this state is hereinafter referred to as a diaphragm section contracted state). Furthermore, the atmosphere communication valve 9 is open.

In the state shown in FIG. 2, the pressing section 20*a* of the first cam 20 presses the right end of the atmosphere valve lever 21 against the bias force of the compression spring 23. Thus, the atmosphere communication valve 9, provided at the left end of the atmosphere valve lever 21, closes the atmosphere communication port 8*a*. Furthermore, the pressing section 25*a* of the second cam 25 is separated from the diaphragm lever 27 which is in abutting contact with the circular outer peripheral surface of the cam 25 owing to the bias force of the spring 28. At this time, the left end of the diaphragm lever 27 is prevented from pressing the diaphragm section 3 (open state). The diaphragm section 3 is thus kept expanded.

First, the motor 14 is driven to rotate the driving gear 14*a* in a direction S2. The rotational force of the driving gear 14*a* is transmitted to the planetary gear 16 via the idle gear 15. The planetary gear 16 rotates around a pivotal-movement center shaft. At a fixed position, the idle gear 15 rotates around a shaft (not shown in the drawings) held at a fixed position. Rotation of the planetary gear 16 allows the first cam 20 to rotate together with the first gear 19 meshed with the planetary gear 16. Then, the pressing section 20*a* is separated from the right end of the atmosphere valve lever 21. As a result, the atmosphere valve lever 21 rotates counterclockwise in FIG. 2 around the supporting point 22 owing to the elastic force of the compression spring 23. The atmosphere communication valve 9 is moved from the position where the atmosphere communication valve 9 closes the atmosphere communication port 8*a*. This makes the atmosphere communication port 8*a* open to the atmosphere.

Then, when the motor 14 rotates the driving gear 14*a* in the direction S2, the idle gear 15 meshed with the driving gear 14*a* rotates. The rotation of the idle gear 15 moves the planetary gear 16 meshed with the idle gear 15 in the direction R1. The planetary gear 16 then comes into mesh with the second gear 24 as shown in FIG. 3. Thereafter, the motor 14 is continuously driven to rotate the planetary gear 16 around the pivotal-movement center thereof. The pressing section 25*a* then moves to a position where the pressing section 25*a* sits opposite the diaphragm lever 27. The pressing section 25*a* presses the right end of the diaphragm lever 27 against the force of a compression spring 28. Thus, left end of the diaphragm lever 27 presses the diaphragm section 3 and the diaphragm section 3 is contracted (see FIG. 3). Thus, the contracted diaphragm section 3 allows the ink in the diaphragm section 3 to be supplied toward the liquid chamber 4*a* of the subtank 4. As a result, the liquid surface of the ink of the liquid chamber 4 rises. At this time, since the atmosphere communication port 8*a* is open owing to the open state of the atmosphere communication valve 9, the air collected in the upper portion of the subtank 4 is discharged to the atmosphere through the atmosphere communication port 8*a* with rising of the liquid surface of ink in the subtank 4.

As described above, the positional relationship between the diaphragm section 3 and the atmosphere communication valve 9 can be changed from the one shown in FIG. 2 to the one shown in FIG. 3.

The operations of the sections of the printing apparatus will be described, which operations are performed to shift the state in which the diaphragm section 3 is contracted with the atmosphere communication valve 9 open as shown in FIG. 3 to the state in which the diaphragm section 3 is expanded with the atmosphere communication valve 9 closed as shown in FIG. 2.

When the diaphragm is contracted as shown in FIG. 3, the motor 14 is driven to rotate the driving gear 14*a* in the direction S1. Thus, the idle gear 15 rotates to move the planetary gear 16 in the direction R2. The planetary gear 16 then comes into mesh with the first gear 19. Thereafter, the motor 14 is continuously driven to rotate the planetary gear 16 via the idle gear 15. In conjunction with the rotation of the planetary gear 16, the first gear 19 and the first cam 20 rotate. The rotation of the first cam 20 allows the pressing section 20*a* to press the end of the atmosphere valve lever 21 against the force of the compression spring 23. The atmosphere valve lever 21 then rotates around the supporting point thereof. In conjunction with the movement of the atmosphere valve lever 21, the atmosphere communication valve 9 moves to close the atmosphere communication port 8*a* having been opened until then. At this time, the rotation of the motor 14 is temporarily stopped. Furthermore, the diaphragm section 3 keeps contracted as shown in FIG. 3.

After the atmosphere communication port 8*a* is closed by the atmosphere communication valve 9 as described above, the motor 14 is driven to rotate the driving gear 14*a* in the direction S2. In conjunction with the rotation of the driving gear 14*a*, the idle gear 15 rotates to move the planetary gear 16 in the direction R1. The planetary gear 16 thus comes into mesh with the second gear 24. Even after the planetary gear 16 engages with the second gear 24, the driving gear 14*a* continues to rotate under the driving force of the motor 14. The planetary gear 16 then rotates around the pivotal-movement center thereof to rotate the second gear 24. Thus, the pressing section 25*a* of the second cam 25 is separated from the diaphragm lever 27. The diaphragm lever 27 rotates clockwise in FIG. 3 around the supporting point 26 by the bias force of the compression spring 28. As a result, the diaphragm lever 27 releases the pressing force exerted on the diaphragm section 3, which then returns to the expanded state shown in FIG. 2, by the restoring force of the diaphragm section 3. At this time, since the atmosphere communication port 8*a* is closed, the diaphragm section 3 returns to the expanded state. Thus, a negative pressure is generated in the subtank 4 to allow the ink in the main tank 5 to flow into the subtank 4 through the hollow pipe 11.

By repeating the contraction and expansion of the diaphragm and opening and closing of the atmosphere communication port 8*a* as described above, a given amount (in the present embodiment, 0.5 cc) of ink in the main tank 5 is supplied to the subtank 4. In the above-described operation, when the first gear 19 is rotated, the atmosphere valve sensor 43 accurately senses the phases of the first cam 20. Further, when the second gear 24 is rotated, the diaphragm section sensor 42 accurately senses the phases of the second cam 25. Thus, it is accurately recognized whether the atmosphere communication valve 9 is open or closed and a condition of the diaphragm section 3.

Figure 10A:
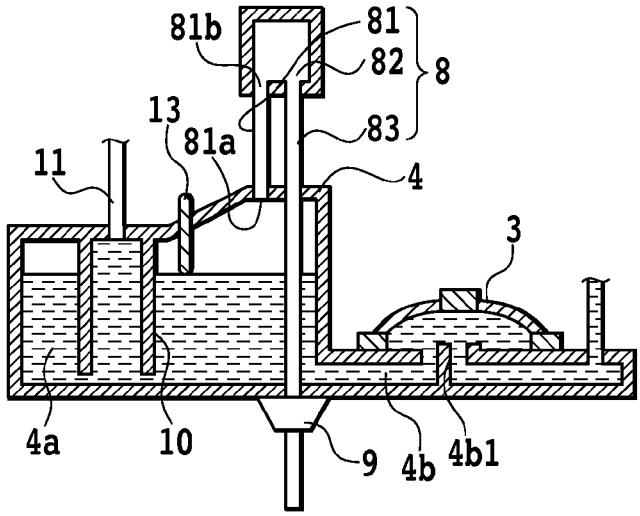
FIG. 10A is a sectional view of the subtank in which the surface of ink has come into contact with a solid pipe in the subtank.
Figure 10B:
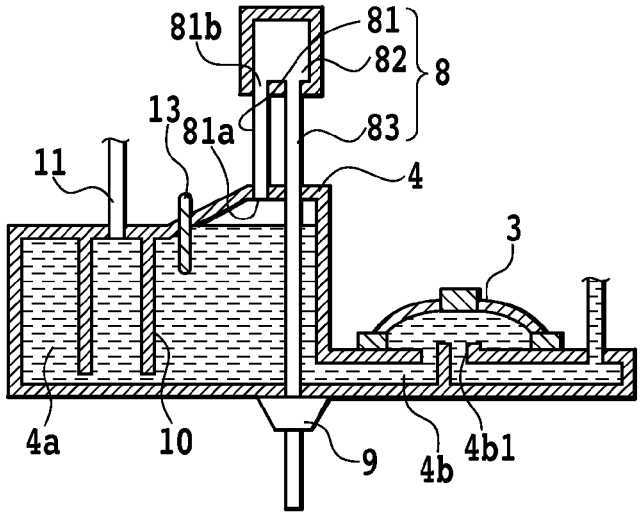
FIG. 10B is a sectional view of the subtank showing that the operation of filling ink into the subtank has been finished.

FIG. 10A shows a condition in which the liquid surface of the ink has come into contact with the solid pipe 13 in the subtank 4. FIG. 10B shows a condition in which the operation of filling ink into the subtank 4 has been finished.

In the operation of filling ink into the subtank 4, a judgment can be performed by sensing whether or not electric continuity is established in a space between the solid pipe 13 and the hollow pipe 11. FIG. 10A shows a state observed immediately after the space has been filled with ink to allow electric continuity to be established (S205). In the present embodiment, the subtank 4 is configured such that the top surface of the subtank 4 is inclined and that the discharge port through which air is discharged to the atmosphere is positioned above the inclined surface. The subtank 4 is further configured such that the inlet through which ink is introduced from the main tank 5 into the subtank 4 is positioned below the inclined surface and that the solid pipe 13, which allows sensing of the presence or absence of ink, is positioned in the middle of the inclined surface. Thus, the air collected in the subtank 4 is smoothly removed via the atmosphere communication path 8. The subtank 4 thus formed serves to prevent generation of possible erroneous in which the presence of ink fails to be sensed in spite of the filled ink because of a failure to remove air from the interior of the subtank 4. In the state shown in FIG. 10A, a given amount of ink has been filled into the subtank 4. In the present embodiment, the filling operation is thereafter finished by carrying out 10 sets each involving one control operation for the first step and one control operation for the second step (S206). The number of times that the first and second steps are repeated is not limited to 10. Alternatively, the first and second steps may be repeated until the presence of ink is sensed based on determination of whether or not ink is present between the solid pipe 13 and the hollow pipe 11. Alternatively, the amount of ink may be adjusted in accordance with the purpose of the printing.

Furthermore, in the present embodiment, the ratio of the resistance $\Delta P_H$ in the channel from the diaphragm section 3 to the print head 1 to the resistance $\Delta P_T$ in the channel from the diaphragm section 3 to the main tank 5 is:

$$\Delta P_H : \Delta P_T = 11:1 \quad (5).$$

However, the supply tube used in the present invention is not limited to this aspect. A supply tube having a different length and a different inner diameter may be used. In a printing apparatus according to another embodiment in which the supply tube has an inner diameter of ϕ2.4 mm and a length of about 1 m and in which the other arrangements are the same as those of the above-described embodiment, $\Delta P_H:\Delta P_T=6:1$. Here, the resistance in the channel from the diaphragm section 3 to the print head 1 is defined as $\Delta P_H$. The resistance in the channel from the diaphragm section 3 to the main tank 5 is defined as $\Delta P_T$. The subtank 4 is similar to the one in the above-described embodiment; the supply path 10 has an inner diameter of ϕ2 mm to ϕ3 mm and a length of about 20 mm, and the first hollow pipe 11 has an inner diameter of ϕ1.6 mm and a length of about 30 mm. This embodiment exerts almost the same effects as those of the above-described embodiment.

With the above-described magnitude relation in channel resistance, substantially the same effects as those of the embodiments of the present invention can be exerted by controlling the speed at which the diaphragm section is opened and closed, or the like.

Furthermore, in the configuration of the printing apparatus according to the present embodiment, the means for forming a negative pressure required to supply ink into the subtank 4 and the driving mechanism configured to remove air from the interior of the subtank 4 can use same driving source in common. In the present embodiment, the operation of varying the volume of the diaphragm section 3 and the operation of opening and closing the atmosphere communication valve 9 are selectively performed. Hence, the single driving source is used both to form a negative pressure in the subtank 4 and to remove air from the subtank 4.

Here, the method for filling ink into the subtank 4 according to the present embodiment includes a step of reducing the volume of the diaphragm section 3 (S202) which enables the volume of the subtank 4 to be changed after the atmosphere communication port 8*a* has been opened. The method for filling ink into the subtank 4 according to the present embodiment includes a step of expanding the volume of the diaphragm section 3 (S201) after the atmosphere communication port 8*a* has been closed. In this case, to allow ink to be quickly supplied to the subtank 4, in a step of reducing the volume of the diaphragm section 3, the time from the start of opening of the atmosphere communication port 8*a* till the start of reduction of the volume of the diaphragm section 3 is preferably set to a smaller value. In the present embodiment, the time from the start of opening of the atmosphere communication port 8*a* till the start of reduction of the volume of the diaphragm section 3 is set to within five seconds. Furthermore, similarly, also in a step of the expanding volume of the diaphragm section 3 after the atmosphere communication port 8*a* has been closed, the time from the start of closing of the atmosphere communication port 8*a* till the start of increase of the volume of the diaphragm section 3 is preferably set to a smaller value. In the present embodiment, the time from the start of closing of the atmosphere communication port 8*a* till the start of increase of the volume of the diaphragm section 3 is set to within five seconds.

Moreover, the time between the step of reducing the volume of the diaphragm section 3 after the atmosphere communication port 8*a* has been opened and the step of expanding the volume of the diaphragm section 3 after the atmosphere communication port 8*a* has been closed is preferably set to a smaller value. In the present embodiment, when the step of reducing the volume of the diaphragm section 3 and the step of expanding the volume of the diaphragm section 3 are repeated, each step requires finishing within five seconds.

In the present embodiment, a construction such that the operation of the diaphragm section 3 and the opening and closing of the atmosphere communication valve 9 are performed by using the springs to bias the atmosphere valve lever 21 and the diaphragm lever 27 and changing the rotating direction of the motor 14 and thus the gear to mesh with the planetary gear 16 is applied. However, the present invention is not limited to the present embodiment, motors may be installed so as to drive the first gear 19 and the second gear 24 separately to drive the first gear 19 and the second gear 24 respectively.

Furthermore, the printing apparatus according to the present embodiment is not limited to the tube supply type and the serial scan type. The present invention is applicable to a full-line printing apparatus that uses a print head extending all along the width of the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-056899, filed Mar. 10, 2009, which is hereby incorporated by reference herein in its entirety.

What is claimed is:

1. An ink jet printing apparatus comprising:

a print head configured to perform printing by ejecting ink supplied from a first ink tank removably mounted in a printing apparatus main body;

a second ink tank configured to be able to temporarily store, between the first ink tank and the print head, ink supplied from the first ink tank to the print head;

a volume changing member configured to be able to change volume of the second ink tank;

an atmosphere communication port configured to enable an interior of the second ink tank to communicate with atmosphere; and a driving mechanism configured to control changing of the volume of the volume changing member and opening and closing of the atmosphere communication port, wherein, the driving mechanism opens the atmosphere communication port and then the volume changing member reduces the volume of the second ink tank, and subsequently closes the atmosphere communication port and then the volume changing member increases the volume of the second ink tank, thus the ink accommodated in the first ink tank is supplied to the second ink tank.

2. The ink jet printing apparatus according to claim 1, wherein the driving mechanism is driven by a single driving source to selectively perform an operation of changing the volume of the volume changing member and an operation of opening and closing the atmosphere communication port.

3. The ink jet printing apparatus according to claim 1, wherein after the volume of the volume changing member is reduced, a flow rate of ink flowing from the volume changing member to the first ink tank is higher than that of ink flowing from the volume changing member to the print head.

4. The ink jet printing apparatus according to claim 1, wherein the volume changing member is a diaphragm.

5. The ink jet printing apparatus according to claim 1, wherein in the driving mechanism, a gear configured to transmit a driving force from a driving source selectively moves between meshing with a gear configured to operate the volume changing member and meshing with a gear configured to open and close the atmosphere communication port, thus selectively performing one of the operation of changing the volume of the volume changing member and the operation of opening and closing the atmosphere communication port.

6. The ink jet printing apparatus according to claim 1, wherein the second ink tank includes a liquid chamber section and a channel section, and the volume changing member is provided in the channel section of the second ink tank.

7. The ink jet printing apparatus according to claim 1, wherein the second ink tank includes a liquid chamber section and a channel section, and the volume changing member is provided in the liquid chamber section of the second ink tank.

8. The ink jet printing apparatus according to claim 1, wherein an ink presence sensor, configured to detect whether or not ink is present to sense when supplying of the ink from the first ink tank is stopped, is attached to inside of the second ink tank at a position close to a supply port through which ink from the first ink tank is supplied.

9. The ink jet printing apparatus according to claim 1, wherein a first ink tank installation sensor is mounted to sense that the first ink tank filled with ink has been installed.

10. A method for filling ink into a second ink tank in an ink jet printing apparatus, the ink jet printing apparatus comprising a print head configured to perform printing by ejecting ink supplied from a first ink tank removably mounted in a printing apparatus main body, the second ink tank configured to be able to temporarily store ink supplied from the first ink tank to the print head between the first ink tank and the print head, and a driving mechanism, said method comprising:

a step of using the driving mechanism to open an atmosphere communication port configured to allow an interior of the second ink tank to communicate with atmosphere and then using the driving mechanism to reduce a volume of a volume changing member configured to be able to change a volume of the second ink tank; and a step of using the driving mechanism to close the atmosphere communication port and then increase the volume of the volume changing member.

* * * * *